United States Patent [19]

Jeffers

[11] Patent Number: 4,949,519

[45] Date of Patent: Aug. 21, 1990

[54] FASTENER ARRANGEMENT FOR SECURING AN EDGE CAP TO AN UPSTANDING WALL PANEL

[75] Inventor: Robert E. Jeffers, Ada, Mich.

[73] Assignee: Westinghouse Electric Corp., Pittsburgh, Pa.

[21] Appl. No.: 313,559

[22] Filed: Feb. 22, 1989

[51] Int. Cl.[5] ..... E04B 2/74

[52] U.S. Cl. ..... 52/239; 52/287; 52/718.1; 52/242

[58] Field of Search ..... 52/242, 238.1, 239, 52/242, 287, 718

[56] References Cited

U.S. PATENT DOCUMENTS

| | | | |
|---|---|---|---|
| 3,590,541 | 7/1971 | Epstein et al. | 52/718.1 |
| 3,762,116 | 10/1973 | Anderson et al . . | |
| 4,104,838 | 8/1978 | Hage et al. . | |
| 4,338,990 | 7/1982 | Blodee et al. | 52/71 |
| 4,424,654 | 1/1984 | Anderson et al. . | |
| 4,513,557 | 4/1985 | Wendt | 52/242 |
| 4,611,448 | 9/1986 | DeLong . | |

*Primary Examiner*—David A. Scherbel
*Assistant Examiner*—Caroline D. Dennison
*Attorney, Agent, or Firm*—D. R. Lackey

[57] ABSTRACT

A space dividing wall panel system having a non-metallic edge cap which is channel shaped in cross section, including a bight and first and second depending leg portions. The edge cap is attached to an outer edge of a wall panel by a plurality of metallic spring clips which are fixed to the outer edge. Each spring clip includes first and second upstanding leg portions having flanged ends which define a plurality of spaced teeth. The dimension between the depending leg portions of the edge cap is less than the dimension between the teeth of the upstanding leg portions, such that the edge cap may be forced downwardly over the spring clips, causing the upstanding leg portions of each spring clip to flex inwardly such that the teeth non-destructively bite into the edge cap and resist dis-assembly.

11 Claims, 4 Drawing Sheets

FASTENER ARRANGEMENT FOR SECURING AN EDGE CAP TO AN UPSTANDING WALL PANEL

TECHNICAL FIELD

The invention relates in general to space dividing wall panel systems, and more specifically to a fastener arrangement for securing edge caps to wall panels which make up such systems.

BACKGROUND ART

Space dividing wall panel systems, such as disclosed in U.S. Pat. No. 3,762,116 to Anderson et al., connect a plurality of wall panels together to form work stations, corridor walls, and the like. The exposed outer edges of the wall panels are concealed by decorative edge caps. When a metal edge cap is used, the edge cap may be formed with depending leg portions configured to cooperate with fasteners fixed to the edge of a panel, which fasteners have complementary configurations, with either the legs of the edge cap or the fastener flexing as the edge cap is forced into assembled relation with the fasteners.

When non-metallic edge caps are used, such as to enhance an executive work place, the fastener arrangement for the edge caps, which are often formed of wood or wood by-products, becomes more of a challenge. The fastener arrangement must securely hold the edge caps in the desired assembled relation with the wall panels, while allowing dis-assembly and re-assembly of the edge caps without damage to the edge caps or the fastener means.

Hook and loop fasteners usually provide a spongy-feel and different degrees of fit and finish depending upon panel fabric thickness. Christmas tree fasteners often have the problem of fitting so tightly that they must be broken to be removed.

SUMMARY OF THE INVENTION

Briefly, the present invention is a new self aligning fastener arrangement for attaching non-metallic edge caps and non-metallic post covers to wall panels of space dividing wall panel systems, which arrangement enables non-metallic edge caps and post covers to be quickly installed and quickly removed by authorized personnel without damage to the edge caps, post covers or fastener means. Further, the new arrangement fixes the edge caps, and post covers in their requisite positions with a tight bond which is not affected by panel fabric thickness and which will remain secure until authorized personnel wish to remove them.

More specifically, the new fastener arrangement accommodates edge caps and post cap covers having depending leg portions which define flat, vertically oriented inner surfaces. Thus, no special complementary curved or angled configuration is required for the edge caps and post cap covers, simplifying their construction and reducing their cost. The depending leg portions which define the flat vertically oriented surfaces may thus be formed of wood, or other non-metallic material, which would be difficult and/or costly to form into curved or angled configurations.

The fastener means for an edge cap includes a plurality of metallic spring clips, and means for attaching the metallic spring clips to a wall panel edge which is to receive an edge cap. Each metallic clip includes a flat base portion having first and second sides and first and second ends. The sides are parallel with the longitudinal dimension of the associated panel edge, and the ends are transverse to the longitudinal dimension. The first and second sides of each metallic clip terminate in an upstanding leg portion which is slightly inwardly converging, rather than being perpendicular, and the leg portion terminates in an outwardly extending flange which angles downwardly from a plane disposed parallel with the flat base portion of the clip. The terminating end of each flange defines a plurality of spaced, blunt teeth, e.g., each tooth is about as wide as the spacing between adjacent teeth. The spring clip is dimensioned such that the dimension between the outer edges of the teeth associated with the first and second upstanding leg portions is slightly greater than the dimension between the flat inner surfaces of the depending leg portions of the associated edge cap. The spring clips are attached to an edge of a wall panel, using a screw and a large washer to give rigidity to the flat base and direct flexing to the upstanding leg portions and associated toothed flanges. When the spring clip is for a top edge cap, and the spring is close to an adjacent wall panel, instead of a washer and screw, the spring clip is dimensioned such that it will be securely fastened in the proper position by a panel connector or panel rigidizer which extends between the top edges of adjacent panels.

The edge cap is installed in assembled relation with a wall panel simply by placing the edge cap on the plurality of spring clips which are to hold it, and once it is properly aligned longitudinally, striking the edge cap with the palm of the hand. The downwardly extending toothed flanges and associated leg portions of each spring clip flex inwardly as the edge cap is installed, and the resiliency of each spring clip continuously maintains an outward pressure against the flat inner sides of the depending leg portions of the associated edge cap. Attempts to lift the edge cap from its assembled position are resisted by the angular relationship of each tooth against the flat non-metallic surface. The teeth "bite" into the flat non-metallic surface sufficiently to resist all but a force meant for intentional removal of the edge cap, and then the blunt teeth release their hold without damaging either the teeth or the edge cap. The only result of removing an edge cap is a slight scuff mark on the flat inner surfaces where each tooth scraped across the surface. Since the scuff marks are on a concealed surface, the edge cap may be immediately re-used without any maintenance being required on the edge cap or spring clips. A similar spring clip may be used for the post cap cover; or, a round version of the spring clip using similar principles may be used, as desired.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figures 1, 1A:
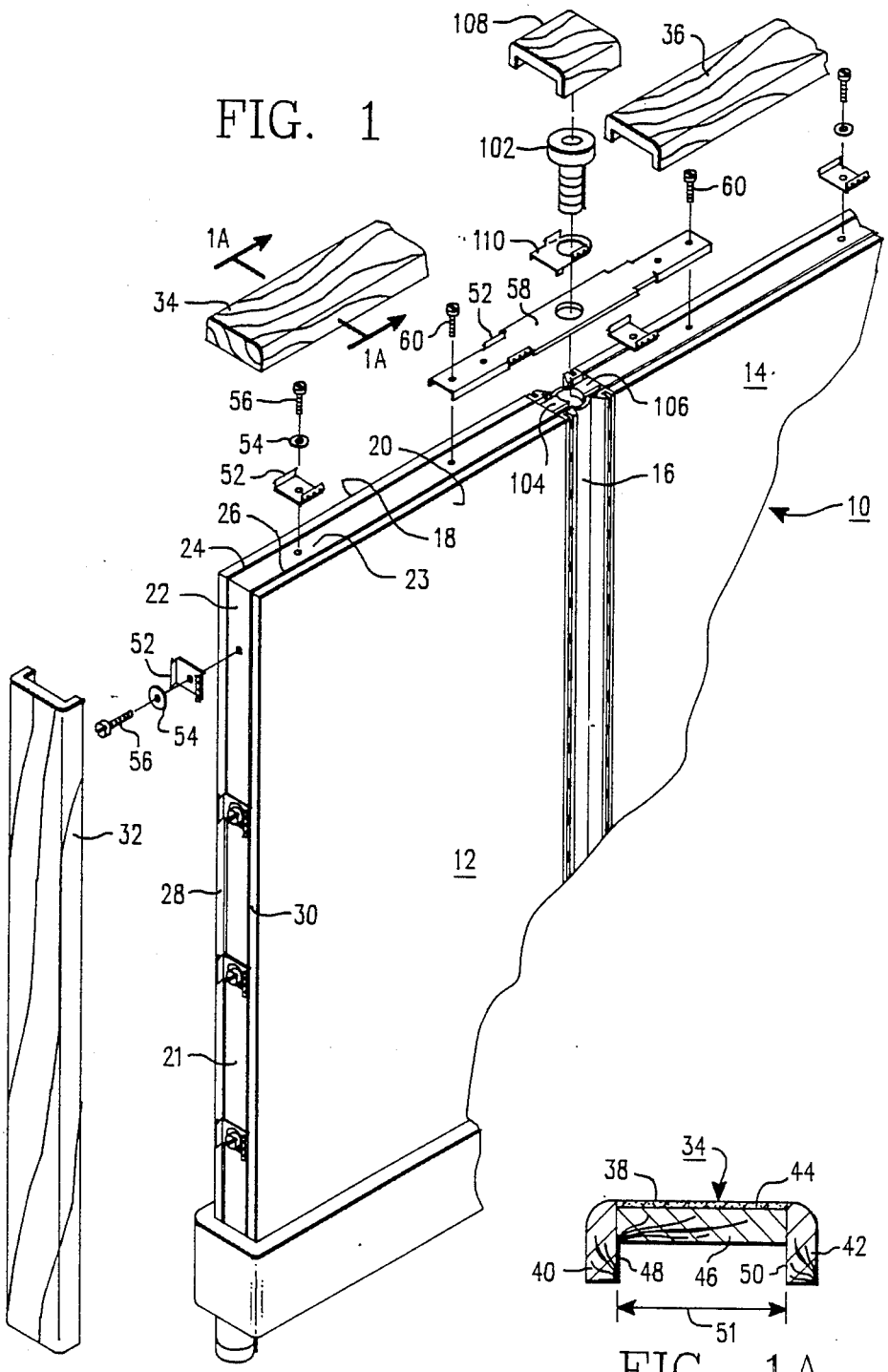
FIG. 1 is a partially exploded perspective view of a space dividing wall panel system having edge caps and a post cap cover fastened thereto according to the teachings of the invention.
FIG. 1A is a cross sectional view of an edge cap shown in FIG. 1, taken between and in the direction of arrows A—A.

Referring now to the drawings, and to FIG. 1 in particular, there is shown a space dividing wall panel system 10 constructed according to the teachings of the invention. Wall panel system 10 includes any desired number of wall panels, with first and second wall panels 12 and 14 being shown for purposes of example. Wall panels 12 and 14 are shown supported by a post 16 as taught in the aforesaid Anderson et al patent, but the invention is applicable to any support arrangement. Wall panels 12 and 14 are shown being aligned along a common longitudinal axis, but they may be disposed at any desired angular orientation, as desired.

Since each wall panel 12 and 14 may be of like construction, only wall panel 12 will be described in detail. Wall panel 12 has first and second major, flat opposed sides or surfaces 18 and 20, respectively, bounded by outer edges, such as side edge 21 and upper edge 23. Wall panel 12 includes an outer frame formed of wood, or it may be a tubular metallic frame 22, as desired. Tubular outer frame 22, as shown in U.S. Pat. No. 4,611,448 to DeLong, has first and second longitudinally extending grooves 24 and 26. Frame 22 may surround, for example, a plywood or like panel septum (not shown) having on each side thereof fiberglass batting covered by an outer fabric 28 and 30; or, any other wall panel construction may be used, such as a wall panel having a gypsum core covered by a fabric.

The exposed outer frame 22 is covered by decorative edge caps 32, 34 and 36, with edge cap 32 being a vertically oriented side cap for wall panel 12, edge cap 34 being a horizontally oriented top cap for wall panel 12, and edge cap 34 being a top cap for wall panel 14. Each edge cap, such as edge cap 34 which is shown in cross section in FIG. 1A, has a channel shaped cross sectional configuration, and it is formed of a non-metallic material, such as wood. FIG. 1A illustrates an exemplary construction when wood is used, with the channel shaped cross sectional configuration including a bight 38 and first and second depending leg portions 40 and 42, respectively. The bight 38 may have a thin outer veneer 44 formed of wood, and a support 46 for the veneer 44 formed of reconstituted wood, fiber board, particle board, and the like. The leg portions 40 and 42 are formed of a wood similar to veneer 38. The first and second depending leg portions respectively define inner flat surfaces 48 and 50 which are parallel with one another and spaced by a predetermined dimension 51.

A fastener arrangement for holding edge caps 32, 34 and 36 to wall panels 12 and 14, includes a plurality of metallic spring clips 52 and means for attaching each spring clip 52 to an edge of a wall panel. The means for attaching spring clips 52 to the wall panels includes a washer 54 and screw 56. When the spring clip would be required to be fixed on the top edge 23 closely adjacent to another wall panel, the means for attaching spring clips 52 may alternatively include a metallic panel connector or rigidizer 58, as disclosed in U.S. Pat. No. 4,424,654 to Anderson et al., which extends between wall panels 12 and 14 and is fixed to their adjacent upper edges, such as by screws 60. The panel rigidizer 58 performs the function of the washer 54, as will be hereinafter explained, and thus the washer 54 is not required when a spring clip 52 is secured to a wall panel by panel rigidizer 58.

Figure 2:
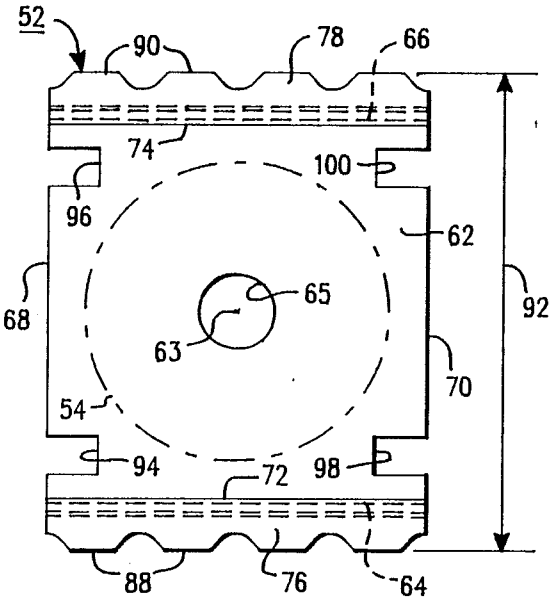
FIG. 2 is a plan view of a metallic spring clip used to attach edge caps to wall panels in FIG. 1.
Figure 3:
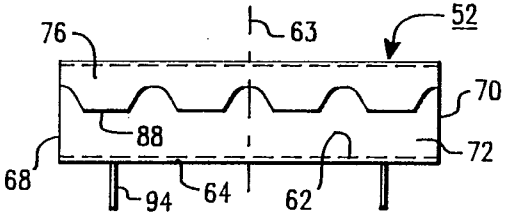
FIG. 3 is an elevational side view of the spring clip shown in FIG. 2.
Figure 4:
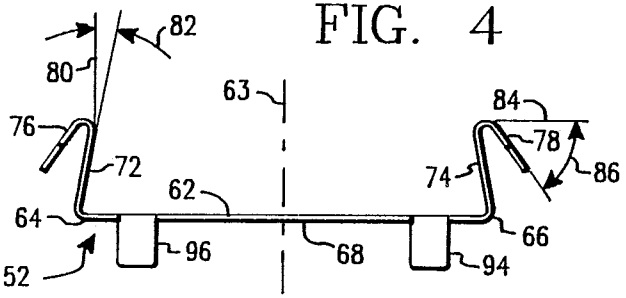
FIG. 4 is an elevational end view of the spring clip shown in FIG. 2.

The construction of spring clip 52 is more clearly shown in FIGS. 2, 3 and 4, which are plan, side and end views, respectively, of spring clip 52. The position of washer 54, when used, is shown in phantom in FIG. 2. Spring clip 52 is formed of a thin sheet of metal, such as a sheet of plain carbon steel, SAE 1050, for example, having a thickness dimension of about 0.015 inch. Spring clip 52 has a flat base portion 62 having a central axis 63, a central opening 65 concentric with axis 63, first and sides 64 and 66 and first and second ends 68 and 70. The first and second sides 64 and 66 terminate in first and second integral upstanding, inwardly converging side portions 72 and 74, respectively, which themselves terminate in first and second flanges 76 and 78, respectively, which angle downwardly with respect to the plane of the flat base 62.

For example, leg portion 72 may converge inwardly by an angle of about 11 to 12 degrees from a plane 80 disposed vertical to base 62, as indicated at 82 in FIG. 4, and leg portion 74 converges inwardly by a like angle. Flange 78 may angle downwardly from a plane 84 disposed parallel with the plane of base 62 by an angle indicated at 86, such as an angle of about 55 degrees, and flange 76 angles downwardly with a like angle.

The extreme ends of flanges 76 and 78 are scalloped to define a plurality of spaced blunt teeth 88 and 90, respectively. A spacing between adjacent teeth which is dimensioned about the same as the width of a tooth at the extreme outer end of the tooth provides the desired bluntness, but other relationships may be used. For example, the width of each tooth, and the spacing between teeth, may be about 0.12 inch, and the depth of each tooth measured from the tip to the root may be about 0.080 inch. The object is to provide a plurality of spaced biting edges which are not so sharp that they dig excessively into the associated non-metallic edge cap, and not so narrow and long that they will exert little outward force when flexed or will have a tendency to bend destructively when an edge cap is removed.

It is desired to have the flanges 76 and 78 resiliently flexible, as well as the leg portions 72 and 74, while retaining a rigidity in base 62 that forces flexing to occur in the leg and flange portions. To accomplish this, the base 62 is strengthened by the use of a large washer 54, which covers the major portion of the base, as illustrated in FIG. 2. When the panel rigidizer 58 is used to secure spring clip 52, the panel rigidizer 58 strengthens base 62, and a washer 54 is not required.

Spring clip 52 is dimensioned between the outermost edges of teeth 88 and 90, as illustrated by dimension 92 in FIG. 2, such that dimension 92 is slightly greater than dimension 51 between the inner surfaces 48 and 50 of the associated edge cap.

When spring clip 52 is to be used with a metallic outer frame 22 having spaced longitudinally extending grooves 24 and 26, end 68 may be formed with spaced depending alignment tabs 94 and 96, and end 70 may be formed with spaced depending alignment tabs 98 and 100. Alignment tabs 94 and 98 will extend into one of the frame grooves, such as groove 26, and alignment tabs 96 and 100 will extend into the remaining frame groove 24, automatically centering spring clip 52 on the thickness dimension of the wall panel.

In the assembly of non-metallic edge caps to the wall panels, such as top cap 34 to wall panel 12, the spring clips 52 are fixed to edge 23, using washers 54 and screws 56 except for the spring clip 52 which may be placed under panel rigidizer 58 at the time panel rigidizer 58 is installed. Top cap 34 is placed in the desired position above spring clips 52, and when it is properly longitudinally aligned it is struck with the palm of the hand at spaced locations along the length of the top cap to seat the top cap snugly along upper edge 23. The rigidized base 62 of spring clip 52 directs substantially all of the flexing to the upstanding leg portions 72 and 74 and their associated flanges 76 and 78, where it is substantially equally shared, as the dimension 92 of spring clip 52 is forced to assume dimension 51 of top cap 34. The spring steel of which spring clip 52 is formed will retain its resiliency, exerting a continuous and constant outward force against inner sides 48 and 50 of edge cap 34, to firmly hold it in assembled relation with wall panel 12 without any sponginess. Should it be desired to remove edge cap 34 for any reason, it may be pried off without damage to the edge cap 34 or to the spring clips 52 due to the configuration of the spring clip wherein the upstanding leg portions 72 and 74 are already inwardly converging, and the ends of teeth 88 and 90 are blunt, notwithstanding the angle of flanges 76 and 78 relative to inner surfaces 48 and 50 which is selected to require a relative large initial force to overcome the biting action of the downwardly angled teeth.

Post 16 includes a post cap screw 102, commonly referred to simply as a "post cap", which is threadably engaged with an aperture in the uppermost end of post 16. The post cap screw 102 prevents panel hooks 104 and 106 from being dislodged from support surfaces defined by post 16, with hooks 104 and 106 being upper support points for wall panels 12 and 14, respectively, on post 16. Post cap 102 also aids in holding panel rigidizer 58 in assembled relation with wall panels 12 and 14.

A post cap cover 108 for continuing the decorative trim effect of the edge caps is normally attached to the post cap 102 via a Christmas tree fastener which depends from cover 108. The Christmas tree fastener is forced downwardly into a grooved aperture in the top of post cap 102, and it often fits so tightly that it must be broken to be removed. The present invention secures the post cap cover 108 to the top of post 16 via a metallic spring clip 110. The construction of spring clip 110 is shown in detail in FIGS. 5, 6 and 7.

Figure 5:
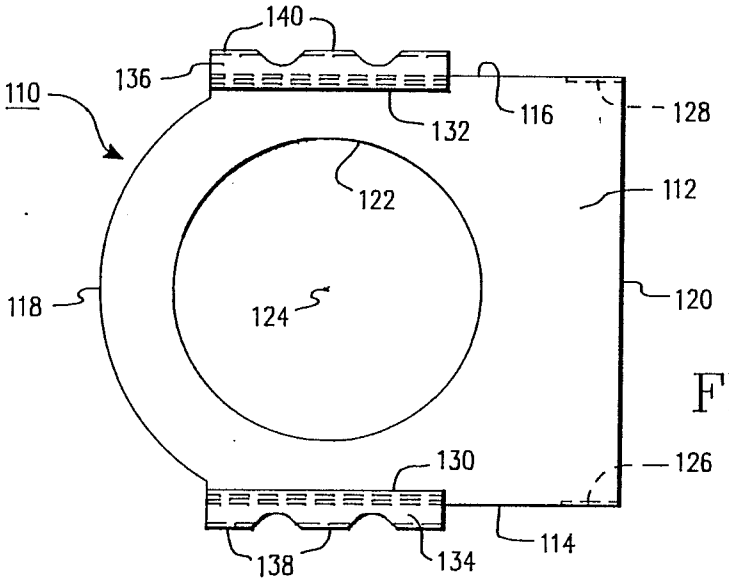
FIG. 5 is a plan view of a metallic spring clip used to attach a post cap cover to a post in FIG. 1.
Figure 6:
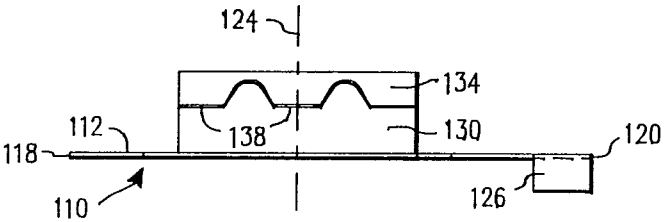
FIG. 6 is an elevational side view of the metallic spring clip shown in FIG. 5.
Figure 7:
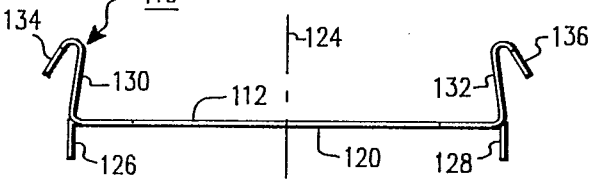
FIG. 7 is an elevational end view of the spring clip shown in FIG. 5.

FIGS. 5, 6 and 7 are plan, side and end views, respectively, of spring clip 110. In general, post cap cover 108 has a cross sectional configuration which is similar to that shown in FIG. 1A for edge cap 34, and spring clip 110 is similar in construction to spring clip 52. Spring clip 110 is formed of the same thin sheet metal as spring clip 52, and it includes a base portion 112 having first and second sides, 114 and 116, respectively, first and second ends 118 and 120, respectively, and an opening 122 having an axis 124. End 120 is elongated with respect to axis 124, terminating in first and second alignment tabs 126 and 128, respectively, spaced to align the tabs with the sides of panel rigidizer 58. Opening 122 is sized to accommodate the shank of post cap 102, with the head of post cap 102 frictionally engaging and clamping spring clip 110 to tightly hold it in the desired position, as well as to add rigidity to base 112.

Since post cap cover 108 is relatively light in weight and much shorter than edge caps 32, 34 and 36, spring clip 110 need not be constructed to provide the same frictional holding power as spring clip 52. More specifically, a short portion of sides 114 and 116 terminate in first and second upstanding, inwardly converging leg portions 130 and 132, and leg portions 130 and 132 terminate in outwardly extending, downwardly angled flanges 134 and 136, respectively. The extreme ends of flanges 134 and 136 are scalloped to define a plurality of spaced blunt teeth 138 and 140. The flanges 134 and 136 need not be as long as flanges 76 and 78 of spring clip 52, and the inwardly converging angle may be more shallow, such as 9 degrees from a plane disposed vertical to base 112, to reduce the holding force of clip 110 to only that required for the post cap cover holding function.

Figure 8:
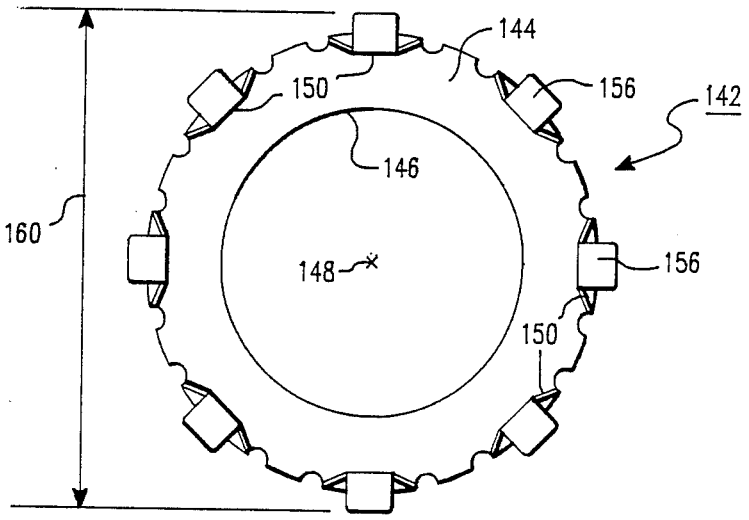
FIG. 8 is a plan view of another embodiment of a post cap cover clip which may be used to attach a post cover to a post.
Figure 9:
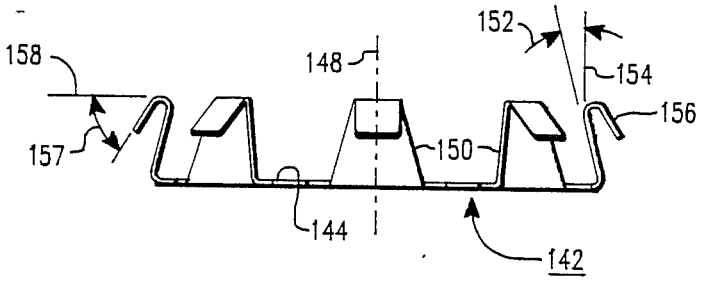
FIG. 9 is an elevational view of the post cap cover clip shown in FIG. 8.

FIGS. 8 and 9 illustrate an alternative post cap cover spring clip 142 which will accommodate a circular opening in the bottom of post cap cover 108, instead of the channel shaped opening illustrated in FIG. 1. Spring clip 142 is formed of the same spring steel as clips 52 and 110, having a circular shaped base 144 which defines an opening 146 having an axis 148. Opening 146 is dimensioned the same as opening 122 in spring clip 110, to receive the shank of post cap screw 102.

Base 144 terminates in a plurality of spaced upstanding, inwardly converging leg portions 150, with a suitable angle 152 from a plane 154 disposed vertically to a plane 154 being about 14 degrees. Each leg portion 150 terminates in an outwardly extending flange 156 which angles downwardly at an angle indicated at 157 from a plane 158 disposed parallel with base 144, which angle may be about 55 degrees. Flange 156 functions as a blunt tooth, in the same manner as teeth 88, 90, 138 and 140 of spring clips 52 and 110. The diametric dimension 160 of spring clip 142, measured between the extremities of flanges 156 on opposite sides of clip 142 is selected to be slightly greater than the diameter of the circular opening formed in the bottom of post cap cover 108, to provide the desired flexing of legs 150 and flanges 156 when the post cap cover 108 is placed on spring clip 142 and positioned by striking it with the palm of a hand.

I claim:

1. In a space dividing wall panel system which includes a first upstanding wall panel having first and second flat major opposed sides bounded by outer edges, the improvement comprising:

an elongated non-metallic edge cap having a channel-shaped cross-sectional configuration including a bight and first and second spaced, depending leg portions having inner surfaces oriented perpendicular to the bight, and a predetermined dimension between said inner surfaces, and fastener means for securing said edge cap to a predetermined outer edge of the first wall panel, said predetermined outer edge including a pair of spaced longitudinally extending grooves, said fastener means including a plurality of metallic spring clips, and means for attaching said spring clips to the predetermined outer edge of the first wall panel, each of said spring clips including a flat base portion having first and second sides which are disposed adjacent to the first and second major opposed sides, respectively, of the first wall panel, and first and second ends, said first and second ends of the base portion of each spring clip including a pair of depending orienting tabs which enter the pair of spaced longitudinally extending grooves in said predetermined outer edge, said first and second sides terminating in first and second upstanding, inwardly converging leg portions, respectively, which terminate in outwardly extending flanges which angle downwardly from a plane disposed parallel to the flat base portion, said flanges defining a plurality of spaced teeth, with an outer dimension of each spring clip measured between the teeth defined by the flanges being greater than the predetermined dimension between the depending leg portions of the edge cap, whereby the upstanding leg portions of each spring clip are flexed inwardly by the depending leg portions of the edge cap, with the teeth biting into the inner surfaces of the depending leg portions of the edge cap, to resist dis-assembly of the edge cap from the predetermined outer edge of the first wall panel.

2. In the space dividing wall panel system of claim 1 wherein the upstanding leg portions of each spring clip each converge inwardly from planes disposed perpendicular to the flat base portion by an angle of about 11 degrees, and the flanges angle downwardly from a plane disposed parallel with the base portion by an angle of about 55 degrees.

3. In the space dividing a wall panel system of claim 1 wherein the means fastening a spring clip to the predetermined outer edge of the first wall panel includes a washer member and a screw, with the washer member overlying a substantial portion of the base portion of the spring clip to add rigidity to the base portion which directs flexing of the spring clip to the upstanding leg portions.

4. In the space dividing wall panel system of claim 1 wherein the teeth defined by the flanges of the spring clips are blunt, having a flat terminating edge which is substantially as wide as the spacing between adjacent teeth.

5. In a space dividing wall panel system which includes first and second adjacent upstanding wall panels each having first and second flat major opposed sides bounded by outer edges, the improvement comprising:

panel connector means which extends between and is fixed to predetermined outer edges of the first and second wall panels to hold them in a desired angular orientation, an elongated non-metallic edge cap having a channel-shaped cross-sectional configuration including a bight and first and second spaced, depending leg portions having inner surfaces oriented perpendicular to the bight, and a predetermined dimension between said inner surfaces, and fastener means for securing said edge cap to a predetermined outer edge of the first wall panel, said fastener means including a plurality of metallic spring clips, and means for attaching said spring clips to the predetermined outer edge of the first wall panel, each of said spring clips including a flat base portion having first and second sides which are disposed adjacent to the first and second major opposed sides, respectively, of the first wall panel, and first and second ends, said first and second sides terminating in first and second upstanding, inwardly converging leg portions, respectively, which terminate in outwardly extending flanges which angle downwardly from a plane disposed parallel to the flat base portion, said flanges defining a plurality of spaced teeth, with an outer dimension of each spring clip measured between the teeth defined by the flanges being greater than the predetermined dimension between the depending leg portions of the edge cap, said means for attaching at least one of the spring clips including said panel connector means, whereby the upstanding leg portions of each spring clip are flexed inwardly by the depending leg portions of the edge cap, with the teeth biting into the inner surfaces of the depending leg portions of the edge cap, to resist dis-assembly of the edge cap from the predetermined outer edge of the first wall panel.

6. In a space dividing wall panel system which includes first and second adjacent upstanding wall panels each having first and second flat major opposed sides bounded by outer edges, the improvement comprising:

a post to which said first and second wall panels are connected, panel connector means which extends between and is fixed to predetermined outer edges of the first and second wall panels to hold them in a desired angular orientation, an elongated non-metallic edge cap having a channel-shaped cross-sectional configuration including a bight and first and second spaced, depending leg portions having inner surfaces oriented perpendicular to the bight, and a predetermined dimension between said inner surfaces, and fastener means for securing said edge cap to a predetermined outer edge of the first wall panel, said fastener means including a plurality of metallic spring clips, and means for attaching said spring clips to the predetermined outer edge of the first wall panel, each of said spring clips including a flat base portion having first and second sides which are disposed adjacent to the first and second major opposed sides, respectively, of the first wall panel, and first and second ends, said first and second sides terminating in first and second upstanding, inwardly converging leg portions, respectively, which terminate in outwardly extending flanges which angle downwardly from a plane disposed parallel to the flat base portion, said flanges defining a plurality of spaced teeth, with an outer dimension of each spring clip measured between the teeth defined by the flanges being greater than the predetermined dimension between the depending leg portions of the edge cap, said means for attaching at least one of the spring clips including said panel connector means, whereby the upstanding leg portions of each spring clip are flexed inwardly by the depending leg portions of the edge cap, with the teeth biting into the inner surfaces of the depending leg portions of the edge cap, to resist dis-assembly of the edge cap from the predetermined outer edge of the first wall panel.

7. In the space dividing wall panel system of claim 6 wherein the post includes an upper end which defines a threaded aperture, a post cap screw which extends through an opening in the panel connector and aids in holding the panel connector via threadable engagement between the post cap screw and the threaded aperture defined by the post, and including a non-metallic post cap cover, and fastener means for holding the post cap cover to the upper end of the post, with said fastener means including a post cap cover spring clip fastened to the upper end of the post via the post cap screw.

8. In the space dividing wall panel system of claim 7 wherein the post cap cover has upper and lower ends, and a substantially square outer configuration, with the lower end defining an opening having sides defining a substantially square configuration having a predetermined dimension between opposite sides, and wherein the post cap cover spring clip includes a flat base portion having first and sides and first and second ends, said first and second sides terminating in first and second upstanding, inwardly converging leg portions, respectively, which terminate in outwardly extending flanges which angle downwardly from a plane disposed parallel to the flat base portion, said flanges defining a plurality of spaced teeth, with an outer dimension of each spring clip measured between the teeth defined by the flanges being greater than the predetermined dimension between opposite sides of the opening in post cap cover, whereby the upstanding leg portions of each spring clip are flexed inwardly by inner surfaces of the opening defined by the post cap cover, with the teeth biting into the inner surfaces, to resist dis-assembly of the post cap cover from the post.

9. In the space dividing wall panel system of claim 8 wherein at least one of the first and second ends of the base portion includes a pair of depending orienting tabs spaced by a dimension selected to snugly straddle the panel connector means.

10. In the space dividing wall panel system of claim 7 wherein the post cap cover has upper and lower ends, and a substantially square outer configuration, with the lower end defining an opening having sides defining a substantially circular configuration having a predetermined diameter, and wherein the post cap cover spring clip includes a flat circular base portion having outer edges which terminate in a plurality of spaced teeth each defined by an upstanding, inwardly converging leg portion which terminates in an outwardly extending flange which angles downwardly from a plane disposed parallel to the flat base portion to define a tooth, and wherein an outer diametric dimension of the post cap cover spring clip measured between the teeth is greater than the predetermined diameter of the opening in post cap cover, whereby the upstanding teeth of the post cap cover spring clip are flexed inwardly by the inner surface of the circular opening defined by the post cap cover, with the teeth biting into the inner surface, to resist dis-assembly of the post cap cover from the post.

11. In the space dividing wall panel system of claim 10 wherein the upstanding leg portion of each tooth converges inwardly from planes disposed perpendicular to the flat base portion by an angle of about 14 degrees, and the flange which defines a tooth angles downwardly from a plane disposed parallel with the base portion by an angle of about 55 degrees.

* * * * *